US007044331B2

(12) United States Patent
Lee

(10) Patent No.: US 7,044,331 B2
(45) Date of Patent: May 16, 2006

(54) MEDIA DISPENSER MODULE AND AUTOMATED TELLER MACHINE HAVING THE SAME

(75) Inventor: Byung-Mok Lee, Suwon (KR)

(73) Assignee: LG N-Sys Inc., Seoul (KR)

( * ) Notice: Subject to any disclaimer, the term of this patent is extended or adjusted under 35 U.S.C. 154(b) by 140 days.

(21) Appl. No.: 10/318,194

(22) Filed: Dec. 13, 2002

(65) Prior Publication Data

US 2003/0121973 A1 Jul. 3, 2003

(30) Foreign Application Priority Data

Dec. 29, 2001 (KR) ..... 2001-88534

(51) Int. Cl.

| | |
|---|---|
| ***B65H 3/00*** | (2006.01) |
| ***B65H 59/00*** | (2006.01) |
| ***B65H 1/30*** | (2006.01) |
| ***G07F 11/00*** | (2006.01) |
| ***B65B 59/00*** | (2006.01) |

(52) U.S. Cl. ..... 221/191; 221/282; 221/15; 221/12; 221/13; 221/312 R; 221/130; 312/329; 109/19; 49/394; 292/201

(58) Field of Classification Search ..... 221/191, 221/282, 15, 12, 13, 312 R, 130; 312/329; 109/19; 49/394; 292/201

See application file for complete search history.

(56) References Cited

U.S. PATENT DOCUMENTS

| | | | | |
|---|---|---|---|---|
| 3,675,816 | A * | 7/1972 | Bourke et al. | 194/206 |
| 3,768,695 | A * | 10/1973 | Pearson | 221/227 |
| 3,957,173 | A * | 5/1976 | Roudebush | 221/15 |
| 4,251,009 | A * | 2/1981 | McLaughlin et al. | 221/12 |
| 4,566,608 | A * | 1/1986 | Draper et al. | 221/229 |
| 4,569,461 | A * | 2/1986 | Orr | 221/1 |
| 4,841,592 | A * | 6/1989 | Restivo | 15/210.1 |
| 5,020,958 | A * | 6/1991 | Tuttobene | 414/281 |
| 5,108,166 | A * | 4/1992 | Klix | 312/329 |
| 5,115,941 | A * | 5/1992 | Gueretta | 221/229 |
| 5,273,183 | A * | 12/1993 | Tuttobene | 221/7 |
| 5,454,332 | A * | 10/1995 | Fennelly et al. | 109/19 |
| 5,516,003 | A * | 5/1996 | Hebert | 221/130 |
| 5,531,355 | A * | 7/1996 | Ullmann et al. | 221/191 |
| 5,927,539 | A * | 7/1999 | Truitt et al. | 221/2 |
| 6,279,684 | B1 * | 8/2001 | Lewis | 186/36 |
| 6,295,767 | B1 * | 10/2001 | Barnhill et al. | 52/79.1 |
| 6,626,330 | B1 * | 9/2003 | Ritsche | 222/153.02 |
| 6,793,133 | B1 * | 9/2004 | Magee et al. | 235/379 |

* cited by examiner

*Primary Examiner*—Gene O. Crawford
*Assistant Examiner*—Michael E Butler
(74) *Attorney, Agent, or Firm*—Fleshner & Kim, LLP

(57) ABSTRACT

A media dispenser module for an ATM is provided which has a secure locking mechanism. The media dispenser module may include a casing that is separatably coupled to a discharge portion for media, including a media mounting portion, on which discharged media is mounted, and an opening portion for withdrawing the media mounted on the media mounting portion. A door moving device moves a door along a plane made by the opening portion, and a pair of catching portions are formed on both sides of the media mounting portion. A locking mechanism engages the catching portions when the door completely closes the opening portion so as not to open the door.

15 Claims, 8 Drawing Sheets

MEDIA DISPENSER MODULE AND AUTOMATED TELLER MACHINE HAVING THE SAME

BACKGROUND OF THE INVENTION

1. Field of the Invention

The present invention relates to an automated teller machine.

2. Background of the Related Art

Generally, an automated teller machine (ATM) or a cash dispenser (CD) is a system installed in an area where many people pass by such as bank, convenience store (CVS) or subway station. The ATM/CD allows a user withdraw cash with a simple operation.

When the user puts a card or a bankbook into an inlet (in some cases, the user inputs required information using an operator panel or using a portable communication device such as a mobile phone) and follows procedures using the operator buttons according to the instructions shown on a display device on a front surface, then media such as cash or check and a specification sheet are withdrawn according to the procedures. Generally, the specification sheet is withdrawn through a specification sheet outlet, and the media is provided through a media dispenser module (i.e., a customer access module) on the front surface.

However, in related art ATM/CDs, a structure for locking the opening/closing portion or door of the media customer access module is insecure and an unauthorized user can access the dispensed media improperly from the outside, for example, and steal the cash or check. For example, some customer access modules have a door that is locked with a mechanism located on only one side and therefore the locked status is not secure. When such a door is severely twisted to one side, the media can be removed or stolen. Further, a driving arm that extends away perpendicular to the door in a locking mechanism can also be overcome when the customer access module door is severely twisted, which allows unauthorized access. In addition, a locking mechanism accessible through the door can be easily robbed by an unauthorized intrusion from the outside.

The above references are incorporated by reference herein where appropriate for appropriate teachings of additional or alternative details, features and/or technical background.

SUMMARY OF THE INVENTION

An object of the invention is to solve at least the above problems and/or disadvantages and to provide at least the advantages described hereinafter.

Another object of the present invention is to provide a media dispensing module and an automated teller machine (ATM) having the same by which an interference with a door opening/closing device for opening/closing a door is reduced or prevented.

Another object of the present invention is to provide a media dispensing module and an automated teller machine (ATM) having the same that securely locks a door opening/closing device.

Another object of the present invention is to provide a media dispensing module and an automated teller machine (ATM) having the same that applies even pressure to a door opening/closing device through a locking mechanism.

Another object of the present invention is to provide a media dispensing module and an automated teller machine (ATM) having the same that uses a locking mechanism driving arm that extends parallel to a door opening/closing device or its direction of movement.

To achieve at least the above objects in whole or in part in accordance with the present invention, as embodied and broadly described herein, there is provided an apparatus that includes a casing operably coupled to receive dispensed media, a door that opens and closes the casing, wherein the door moves between a first position where the casing is open and the dispensed media is accessible to the outside and a second position where the casing is closed, wherein the door has a pair of catching portions respectively formed on both sides of the casing, and a lock that selectively engages the catching portions when the door is in the second position to prevent the door leaving the second position when engaged.

To further achieve at least the above objects in whole or in part in accordance with the present invention, as embodied and broadly described herein, there is provided a media dispenser module that includes a casing operably coupled to receive dispensed media that includes a media mounting portion that supports dispensed media and an opening portion that provides access to the media mounting portion, a door that moves by a door moving device to open and close the opening portion, wherein the door has a pair of catching portions formed to correspond to both respective sides of the media mounting portion, and locking unit for locking the catching portions when the door closes the opening portion.

To further achieve at least the above objects in whole or in part in accordance with the present invention, as embodied and broadly described herein, there is provided an automated teller machine (ATM) that includes a conveyor that is configured to convey media loaded on a media cassette, and a media dispenser module operably coupled to the conveyor, wherein the media dispenser module that includes a casing operably coupled to receive dispensed media that includes a media mounting portion that support dispensed media and an opening portion that provides access to the media mounting portion, a door that moves by a door moving device to open and close the opening portion, wherein the door has a pair of catching portions formed to correspond to both respective sides of the media mounting portion, and a locking mechanism that engages the catching portions when the door closes the opening portion, wherein the locking mechanism includes a pair of rotatable members that engage the catching portions when the door is closed, and a member driving portion installed on a side portion of the casing that rotatably moves the pair of members to release the engaged members when the door is opened, wherein the member driving portion extends substantially parallel and moves substantially perpendicular to a moving direction of the door.

Additional advantages, objects, and features of the invention will be set forth in part in the description which follows and in part will become apparent to those having ordinary skill in the art upon examination of the following or may be learned from practice of the invention. The objects and advantages of the invention may be realized and attained as particularly pointed out in the appended claims.

BRIEF DESCRIPTION OF THE DRAWINGS

The invention will be described in detail with reference to the following drawings in which like reference numerals refer to like elements wherein.

DETAILED DESCRIPTION OF PREFERRED EMBODIMENTS

Figure 1:
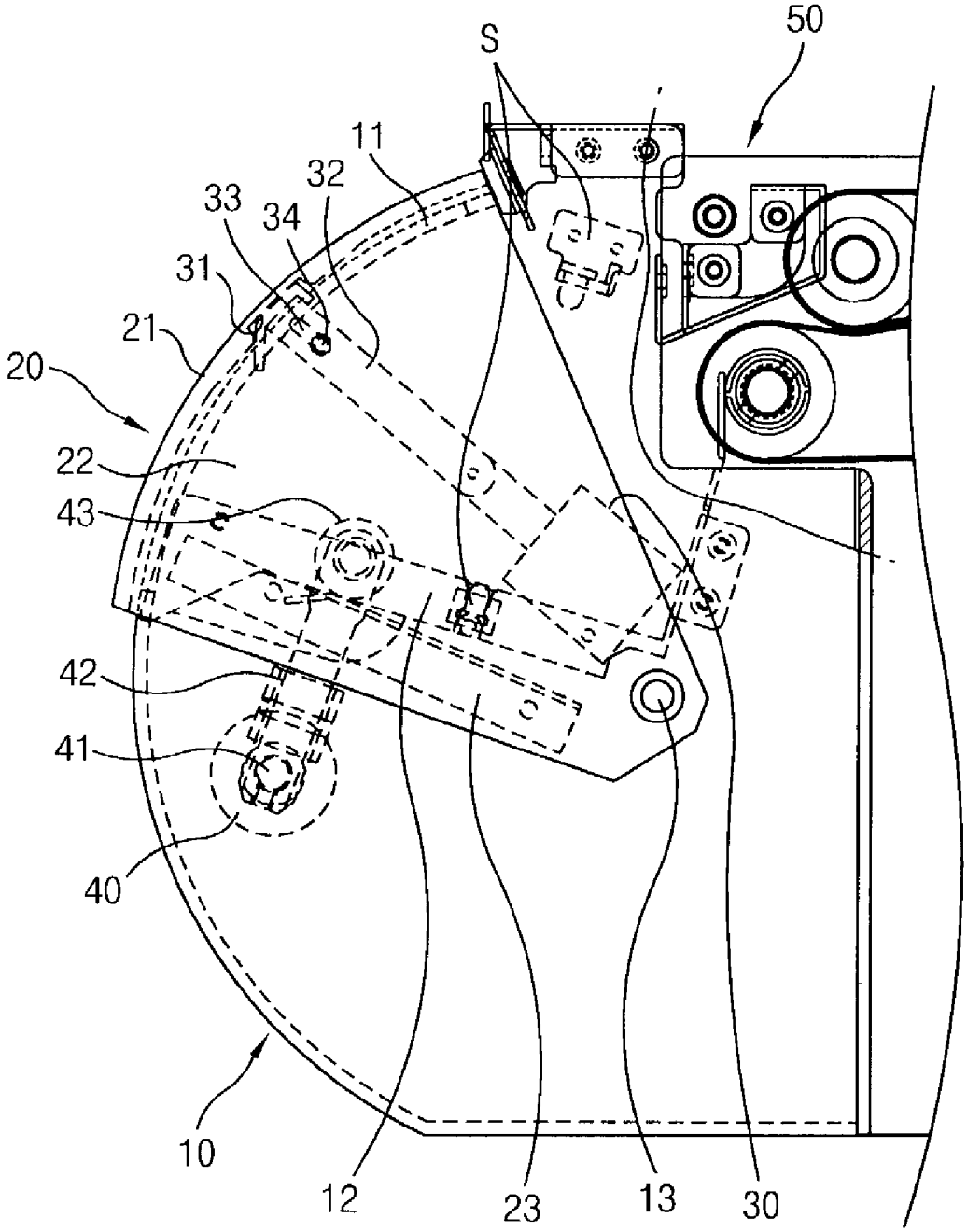
FIG. 1 is a diagram of a side view showing an exemplary media dispenser module of an automated teller machine (ATM)

As shown in FIG. 1, a cross-sectional view of an exemplary automated teller machine (ATM) can have a media dispensing module that includes a casing 10 having an inner space and an opening portion 11 on upper part on a front surface thereof, a media mounting portion 12 having a predetermined length and 'U' shape cross section that is installed in the casing 10 to be a bottom surface of the opening portion 11, a door 20 and a hinge shaft 13 installed in the casing 10 in transverse direction on the front surface of the ATM. The door 20 preferably includes side portions 22 that are extendedly formed as sectors from both side ends of a curved surface portion 21, which is formed to have larger radius of curvature than that of the opening portion 11 in order to cover the opening portion 11 of the casing 10, and coupled to both ends of the hinge shaft 13 respectively.

Also, a catching recess 31 is formed on an inner surface of the curved surface portion 21 of the door 20. A sliding surface portion 23 having predetermined width and length is installed on one inner lower end between the side surface portions 22 as protruded toward the media mounting portion 12.

In addition, a motor 40 is mounted on one inner side of the casing 10. A rotary arm 42 having a predetermined length is fixedly coupled to a motor shaft 41 of the motor 40, and a roller 43 is coupled to a free end of the rotary arm 42. And the roller 43 is installed to contact the sliding surface portion 23 of the door 20.

The motor 40 and the motor shaft 41 are located on front lower side of the casing 10 separated a predetermined distance from the hinge shaft 13, and the rotary arm 42 is coupled to the motor shaft 41 vertically. In addition, the roller 43 is rotatably coupled to side surface of the rotary arm 42. The rotary arm 42 and the roller 43 are located between an outer side surface of the casing and an inner surface of the side surface portion 22 of the door 20.

In addition, a solenoid 30 and a link 32 connected to the solenoid 30 are coupled to the other side surface of the casing 10, that is, the opposite side of the motor 40. A long hole 33 is formed on one end of the link 32, and a guide pin 34 that is fixedly installed on outer wall of the media mounting portion 12 is inserted into the long hole 33. In addition, one end of the link 32 is located inside the catching recess 31 of the door curved surface portion 21 in a state that the door 20 is closed and is extended through the door 20 to be accessable when the door 20 is closed. The guide pin 34 guides the link 32 to be located on the catching recess 31 of the door 20.

In addition, a conveyor 50 for conveying the media loaded on a media cassette (not shown) and dropping the media on the media mounting portion 12 is located on rear upper side of the casing 10. Sensors S for sensing whether or not the media is loaded on the media mounting portion 12 are mounted respectively on the media mounting portion 12 and on one side of the casing 10.

Operations of the media dispenser module in the ATM as shown in FIG. 1 will now be described. After the user inputs the information needed for withdrawing the media such as bills and checks, the media paying processes are performed. Then, the media required by the user is conveyed by the conveyor and piled on the media mounting portion 12, as shown in FIG. 2.

When the media requested by the user is all provided on the media mounting portion 12, the motor 40 drives to rotate the motor shaft 41. Accordingly, the rotary arm 42 is rotated as a certain angle centering around the motor shaft 41, as shown in FIG. 3.

At that time, the solenoid 30 is operated with the driving of the motor 40 to pull the link 32 connected to the solenoid 30. Accordingly, and the end of the link 32 that is located on the catching recess 31 of the curved surface portion 21 on the door 20 is moved to release the locked door 20.

Figure 2:
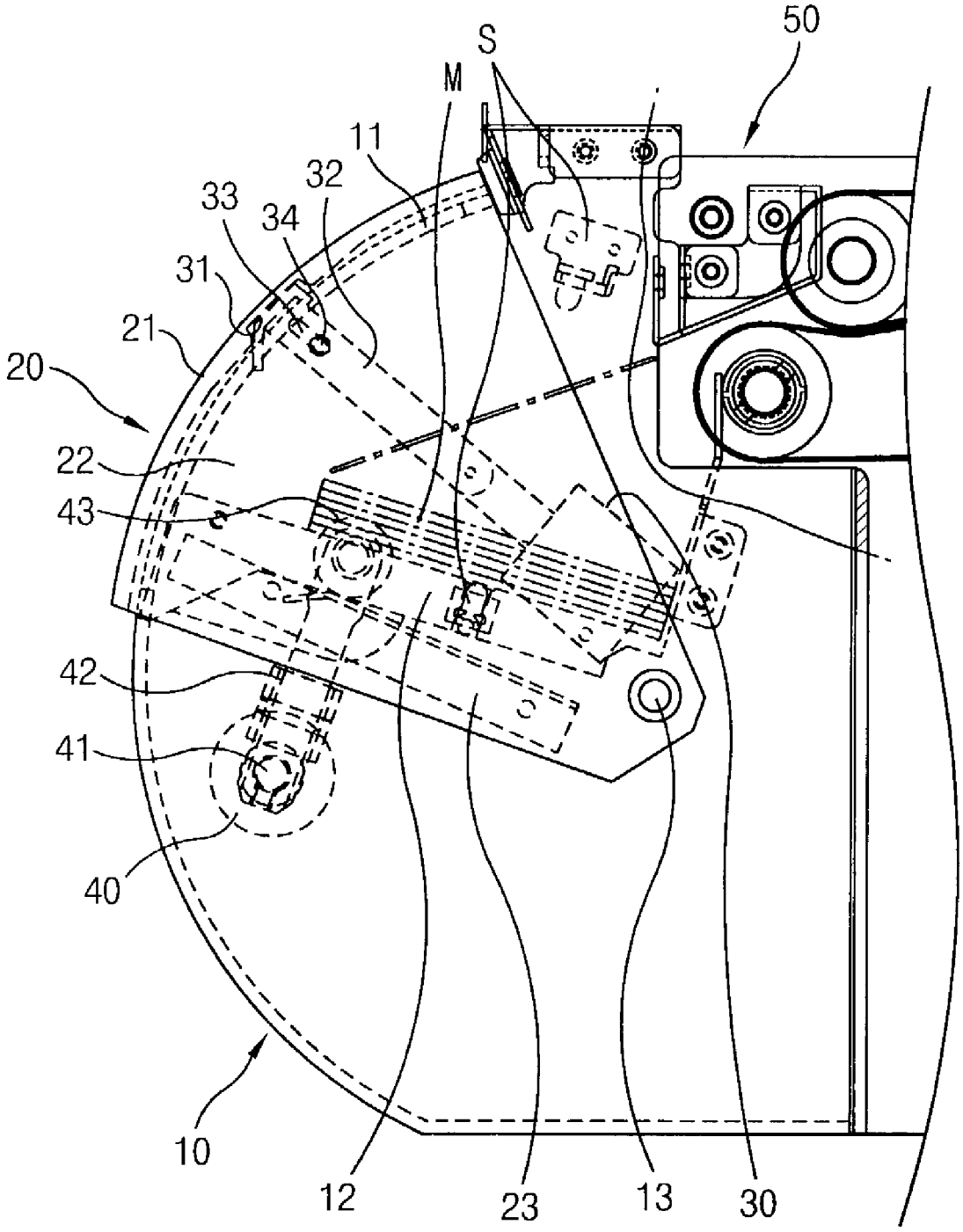
FIG. 2 is a diagram of a side view showing a status immediately before a door of the media dispenser module of FIG. 1 is opened.
Figure 3:
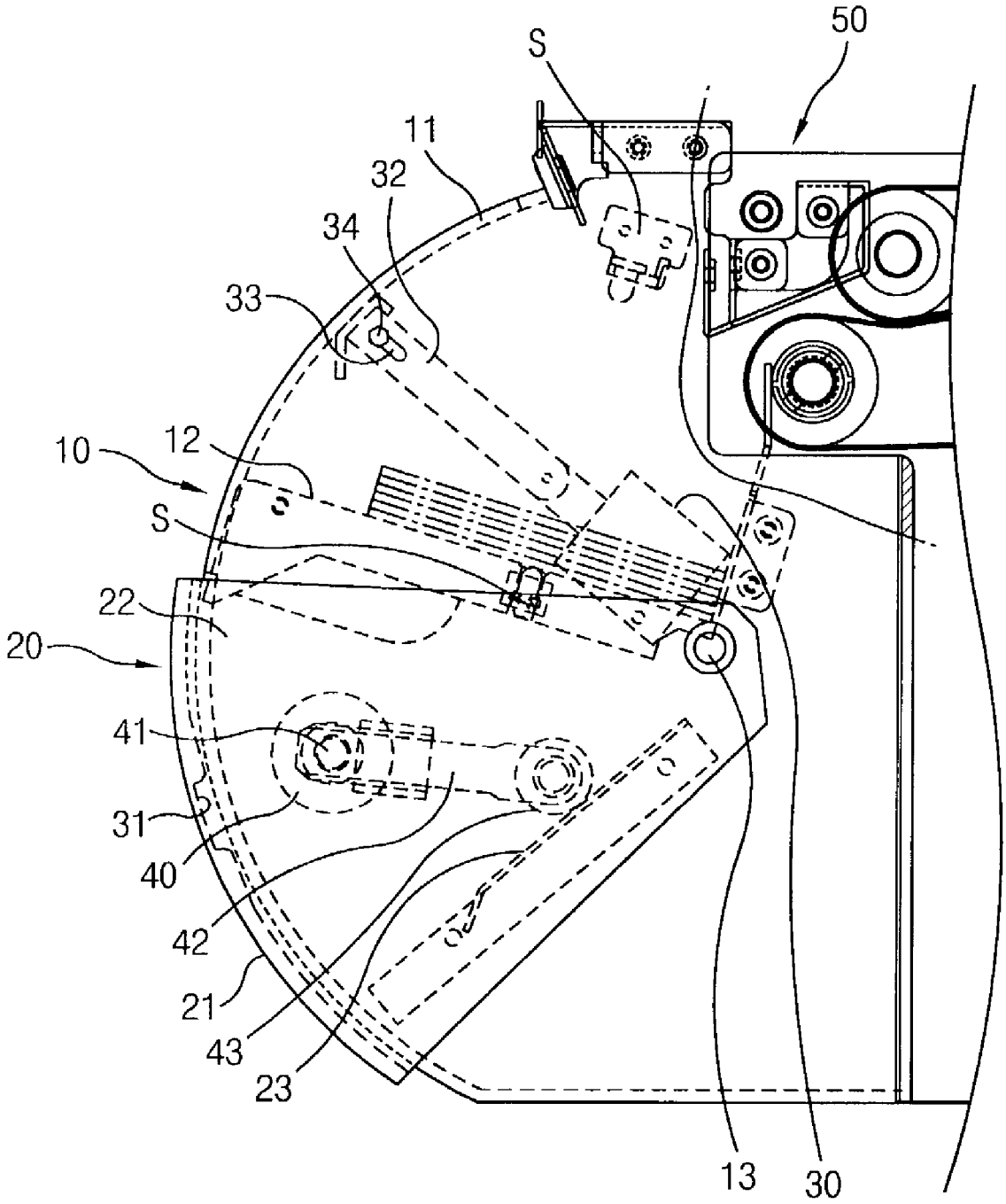
FIG. 3 is a diagram of a side view showing a status that the door of the media dispenser module of FIG. 1 is opened.

As the rotary arm 42 rotates, the roller 43 coupled to the free end of the rotary arm 42 is moved along with the sliding surface portion 23 of the door 20, and then the door 20 is pulled downward as shown in FIGS. 1–3. In addition, the door 20 rotates a certain angle centering around the hinge shaft 13, and accordingly the curved surface portion 21 of the door 20 is moved downward to open the opening portion 11.

The user is able to withdraw the media (M) mounted on the media mounting portion 12 through the opened or exposed opening portion 11. In addition, after the user withdraws the media mounted on the media mounting portion 12, the door 20 is closed after a pre-set time passes by sensing of the sensor S.

The door is closed through processes such that the motor 40 is reversibly rotated to rotate the rotary arm 42 in a reverse direction until located at the original position. At the same time, a tension spring (not shown) coupled to the door 20 makes the door 20 rotate centering around the hinge shaft 13. Thus, the curved surface portion 21 is moved toward upper part to close the opening portion 11.

At that time, the link 32 is moved in the shaft direction by the operation of the solenoid 30, and then, is located in the catching recess 31 of the curved surface portion 21 of the door 20. In this manner, the door 20 is fixed.

However, in the ATM as shown in FIGS. 1–3, the structure for locking the door 20 opening/closing the opening portion 11 of the casing 10 retains the door 20 from only one side of the door 20. Therefore, the locked-up status of the door 20 is not firm and safe. Also, if the door 20 is severely twisted to one side, the media M can be accessible to an unauthorized user.

A preferred embodiment of a media dispenser module of an ATM according to the present invention will now be described. As shown in FIGS. 4 through 8, a preferred embodiment of a media dispenser module includes a casing 100 coupled to a discharge portion 510 of a conveyor 500 that conveys the media from a media cassette (not shown) in which the media is loaded. The casing 100 can include an opening portion 110, a media mounting portion 120, a hinge shaft 130, a door 200 and a locking mechanism. The casing 100 can define an inner space, and have the opening portion 110 formed on upper part of a front surface (e.g., a direction represented by an arrow in FIG. 4) of the ATM. The media mounting portion 120 can have a 'U' shape cross section of transverse direction in FIG. 5 installed in the casing 100 so as to make a bottom surface of the opening portion 110, and the hinge shaft 130 can be installed on rear part of the casing 100. The door 200 preferably includes a catching portion 310 formed in a curved surface 210 that is formed larger than the opening portion 110 so as to open/close the opening portion of the casing 100 and a pair of side surface portions 220. The surface portions 220 preferably have sector shapes that are extendedly formed on both side ends of a curved surface portion 210 and respectively coupled to the hinge shaft 130. The locking mechanism can be caught by the catching portion 310 respectively when the door 200 completely closes the opening portion 110 so as not to allow the door to open.

Figure 6:
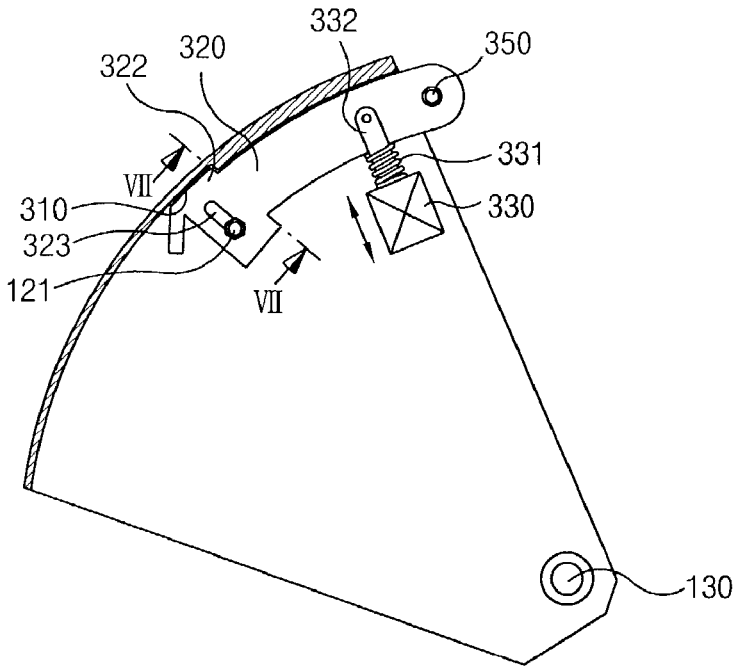
FIG. 6 is a diagram of a partial side cross-sectional view showing locking of the media dispenser module of FIG. 4.
Figure 7:
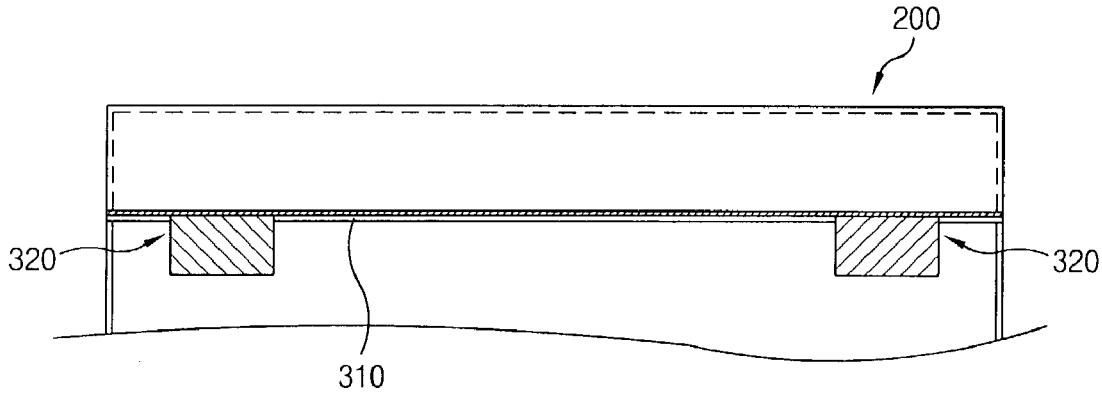
FIG. 7 is a diagram that shows a cross-sectional view along line VII—VII in FIG. 6.

As shown in FIG. 6, the hinge shaft 130 of the door may be a pair fixed respectively on inner side wall of the casing 100 taking the media mounting portion 120 therebetween or fixedly installed respectively on outer side wall of the media mounting portion 120. Further, the side surface portion 220 is formed as a sector, however, a rod rotating centered around the hinge shaft 130 may be used.

The catching portion 310 of the door 200 preferably maintains the locked status of the door 200 by an interaction with a catching member 320 of the locking mechanism and can be modified variously with the catching member 320. The catching portion 310 in accordance with the preferred embodiment shown in FIGS. 4–8 is preferably formed on inner surface of the curved surface portion 210 corresponding to the catching member 320 to be stepped in a transverse direction of FIG. 5.

A sliding surface portion 230 having certain width and length can be protrusively formed on inner lower end of one side surface portion 220 of the door 200. In addition, a motor 400 is mounted on one inner side of the casing 100, a rotary arm 420 is fixedly coupled to a motor shaft 410 of the motor 400, and a roller 430 is coupled to a free end of the rotary end 420. The roller 430 is preferably installed to be engagingly coupled or contacted to the sliding surface portion 230 of the door 200.

The motor 400 and the motor shaft 410 are located on front lower part of the casing 100 preferably separated by a prescribed distance from the hinge shaft 130, and the rotary arm 420 can be coupled vertically to the motor shaft 410, and the roller 430 is coupled to side surface of the rotary arm 420 to be rotatable. However, the present invention is not intended to be so limited as various orientations can be implemented between the motor 400, the roller 430 and the portion 230. The rotary arm 420 and the roller 430 are preferably located between an outer side surface of the casing 100 and the side surface portion 220 of the door 200.

The locking mechanism can include a rotary shaft 350 installed on the casing 100 in transverse direction for the media mounting portion 120 when it is assumed that the door 200 is closed in length direction, and a pair of catching members 320 coupled to the rotary shaft 350 to be rotatable. The catching members are preferably caught by the catching portion 310 when the door 200 is completely closed. A catching member driving portion 330 fixedly installed on a side portion of the media mounting portion 120 for rotating the catching members 320 in order to reciprocably release the engagement or lock of catching members 320 when the door 200 is opened.

The rotary shaft 350 can be installed coupled to an upper part of the media mounting portion 120, that is, the end portion for a closing direction of the door 200 when the door 200 is closed. In addition, the catching member driving portion 330 can be installed on only one side surface of the media mounting portion 120, and in this case, when one of the catching members 320 is rotated by the catching member driving portion 330, the rotary shaft 350 is rotated. Accordingly, the other catching member 320 is also rotated by the rotary shaft 350.

Also, the catching member driving portion 330 is preferably connectedly installed on the respective catching members 320 to synchronize movements of the catching members 320. As shown in FIG. 6, the catching member driving portion 330 is preferably link coupled to a position separated a certain distance apart from the rotary shaft 350. In addition, a solenoid that can move linearly can be used as the catching member driving portion 330.

As shown in FIG. 6, an elastic member 331 may be installed on a shaft 332 of the catching member driving portion 330 so as to support the catching members 320 elastically to go toward the locked position of the door 200. Thus, the catching members preferably are forced or bend toward the door 200 when the catching member driving portion 330 is not considered.

The catching member 320 can have a protruded portion 322 that is formed to be caught by the catching portion 310 of the door 200, and a guide recess 323 formed as a curve centering around the rotary shaft 350 can be on the protruded portion 322. In addition, the guide recess 323 can guide the movement of the catching members 320 because a guide pin 121 fixedly installed on outer side wall of the media mounting portion 120 or on inner side wall of the casing 100 is preferably inserted therein.

In addition, the conveyor 500 for conveying the media stored in the media cassette and dropping the media on the media mounting portion 120 through the discharge hole 510 is located on rear upper part of the casing 100. Sensors S for sensing whether there is the media on the media mounting portion 120 can be mounted respectively on sides of the media mounting portion 120 and of the casing 100.

Figure 4:
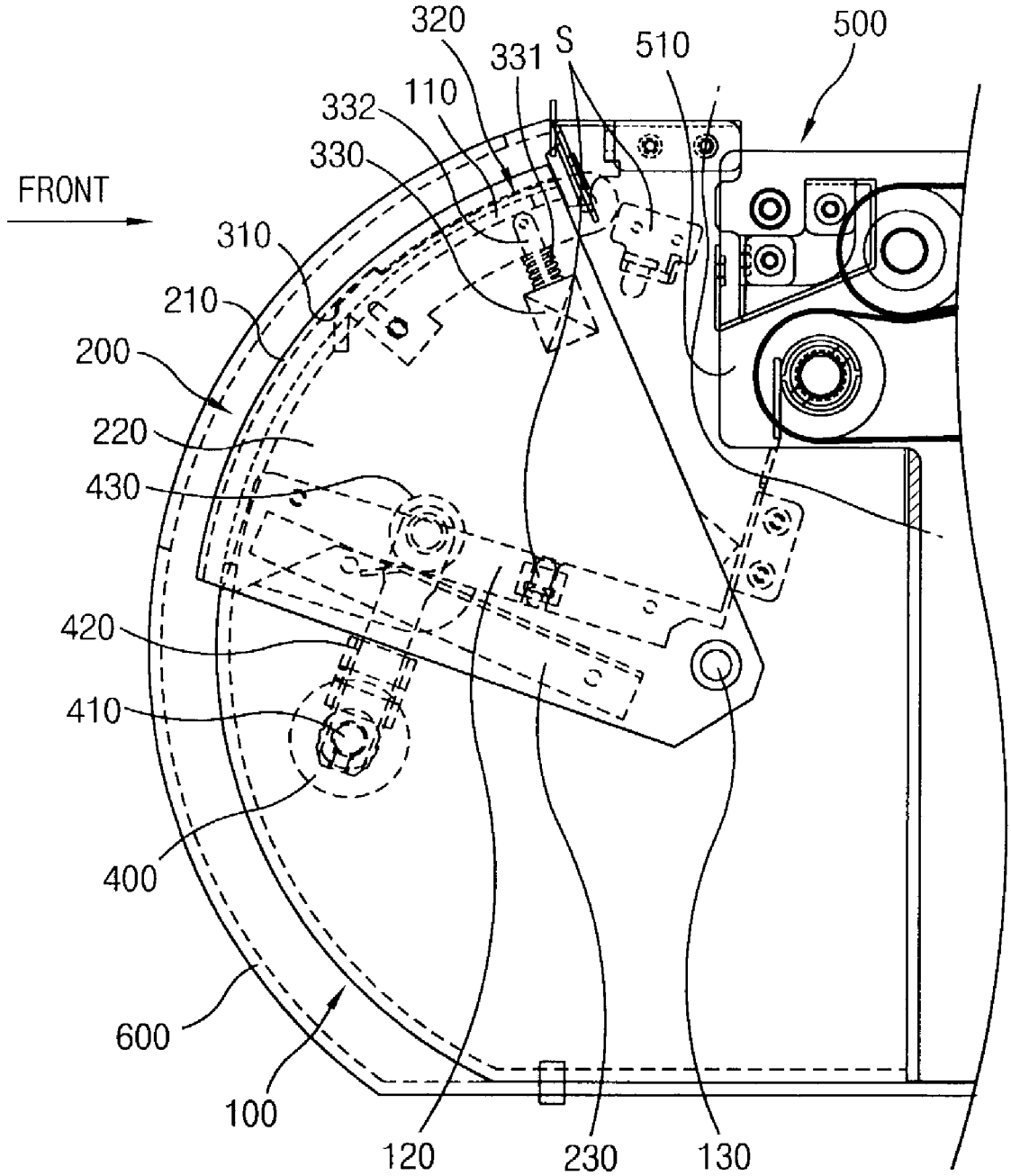
FIG. 4 is a diagram of a side view showing a preferred embodiment of a media dispenser module of an ATM according to the present invention.
Figure 5:
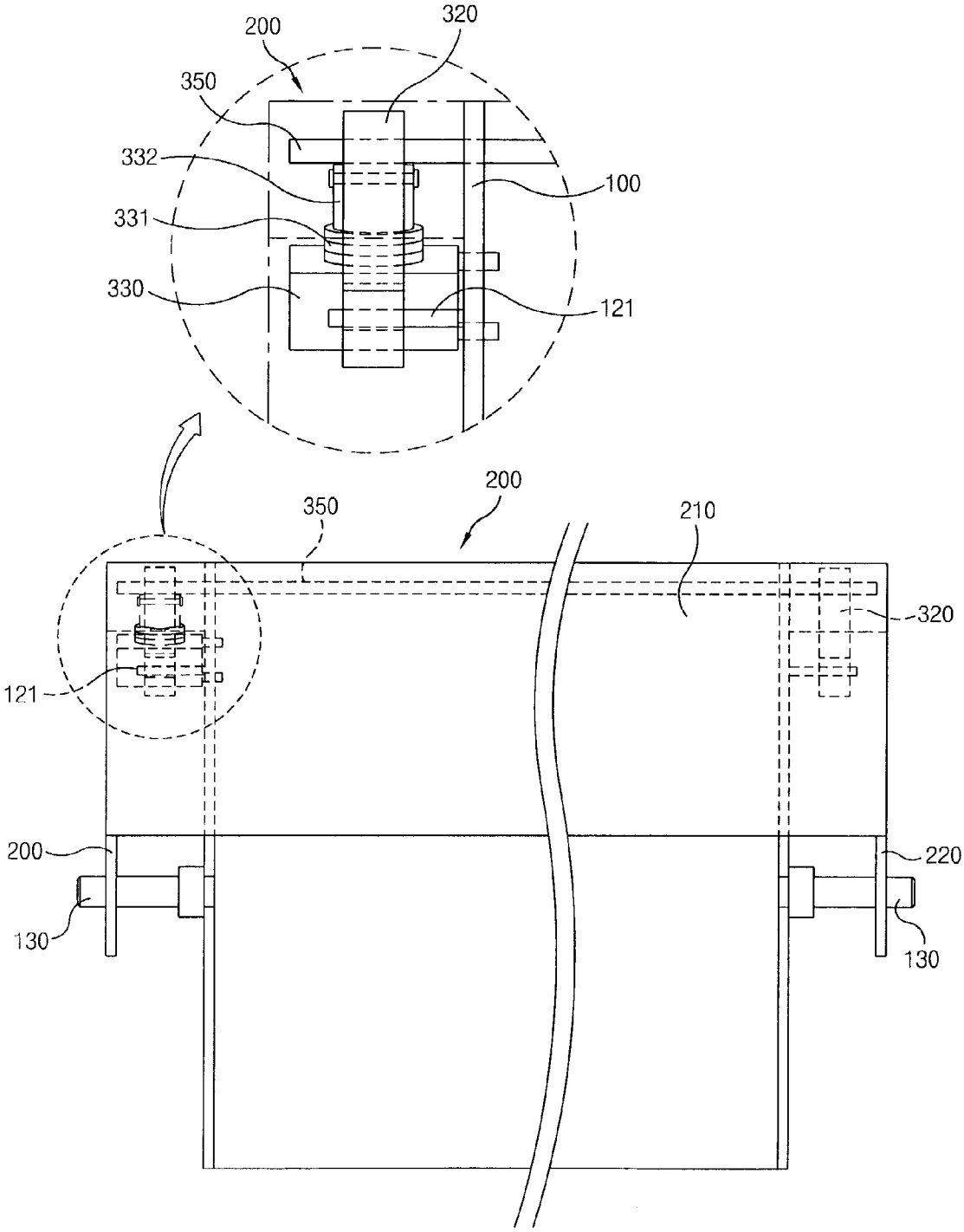
FIG. 5 is a diagram of a view showing some parts of a door and a casing in the media dispenser module of FIG. 4.

As shown in FIG. 4, a cover portion 600 having an opening 610 corresponding to the opening portion 110 can be formed on the front surface of the casing 100 so as not to expose the locking mechanism. Thus, the protruded portion 322 is inaccessible from the outside. However, the present invention is not intended to be so limited.

Operations of the preferred embodiment of the media dispenser module and an ATM that includes the same will now be described. Preferably, the user puts a card/bankbook and inputs required information through an input device (not shown). However, the user may input the required information through the input device without the card or the bankbook, or input the information through a portable communication device.

The ATM conveys the required media from the media cassette to the media dispenser module, that is, a customer dispenser module using the conveyor 500 according to the request of the user. That is, the media requested by the user can be conveyed through the discharge hole 510 of the conveyor, and dropped and piled on the media mounting portion 120.

When all the media such as bills or checks requested by the user is provided on the media mounting portion 120, the catching members 320 of the locking mechanism preferably release the locking with the catching portion 310, and the door 200 rotates centering around the hinge shaft 130 to open the opening portion 110 by the operation of the motor 400 and the rotary arm 420. After the user withdraws the media loaded on the media mounting portion 120 through the opening portion 110, the door 200 can be moved to original position preferably as rotated by reverse-operation of the motor 400 and the rotary arm 420 to close the opening portion 110. At that time, the hinge shaft 130 may be directly rotated in order to make the door 200 come back to the original position, or an additional elastic member (not shown) may be used to make the door 200 come back to the original position.

As shown in FIG. 6, locking operations and releasing operations according to preferred embodiments of the door 200 in a state that the door 200 closes the opening portion 110 of the casing 100 will now be described. As shown in FIG. 6, in the state that the door 200 closes the opening portion 110 of the casing 100, the catching member driving portion 330 is preferably not operated, and the pair of catching members 320 are elastically supported by the elastic force of the elastic member 331 and the protruded portions 322 are engaged or matched with the catching portion 310 of the door 200. Accordingly, the opening of the door 200 can be prevented. At that time, the guide pins 121 tend to be located on lower part of the guide recess 323, respectively, as shown in FIG. 6.

When the opening portion 110 of the casing 100 is opened by rotating the door 200, the catching member driving portion 330 is preferably operated and the shaft of the catching member driving portion 330 pulls one catching member 320, and accordingly, the protruded portion 322 can escape or disengage from the catching portion 310 of the door 200. The other catching member 320 can be rotated as geared with the one catching member 320 by the rotary shaft 350 coupled thereto and the protruded portion 322 of the other catching member 320 can also escape or disengage from the catching portion 310 of the door 200.

Figure 8:
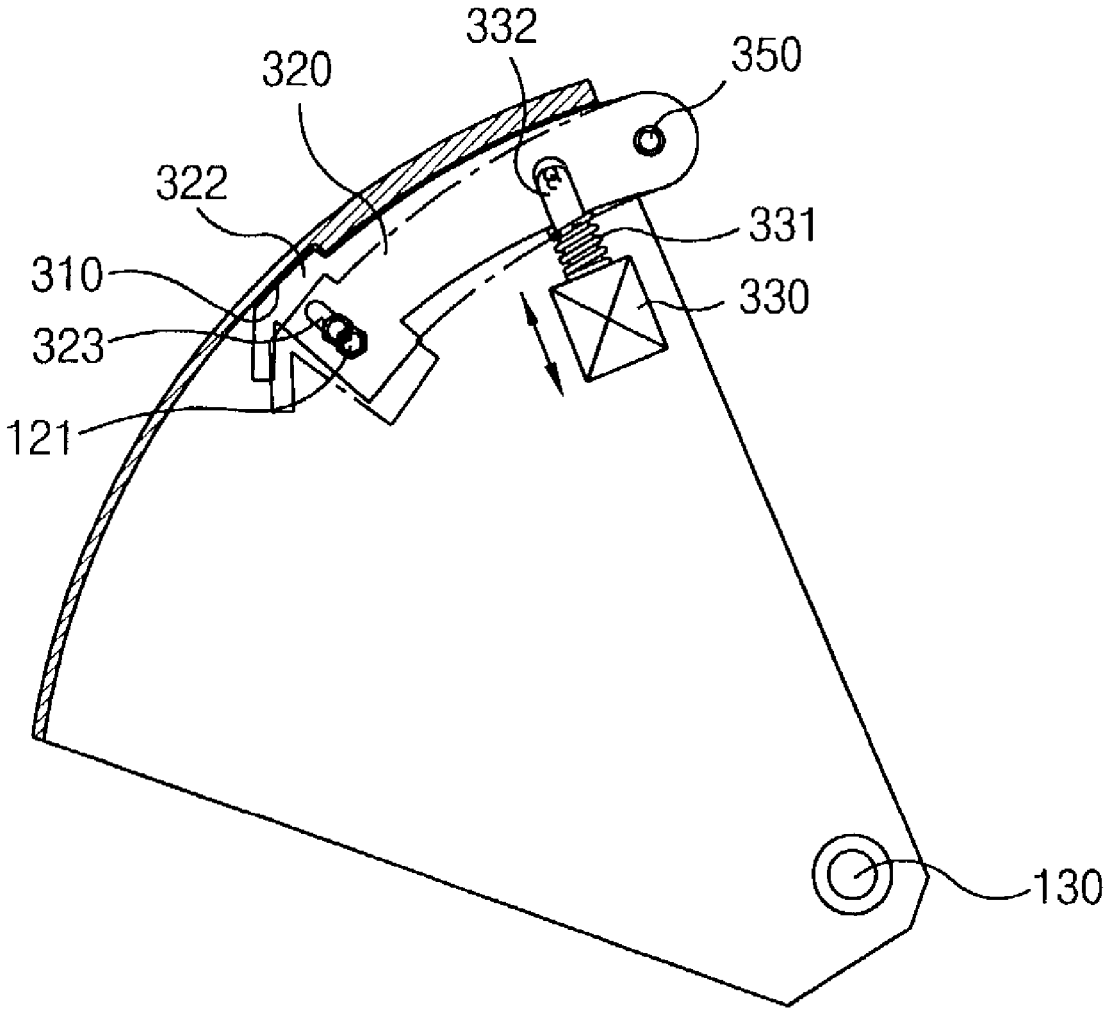
FIG. 8 is a diagram that shows a cross-sectional view showing operations of the locking of the media dispenser module of FIG. 4.
Figure 9:
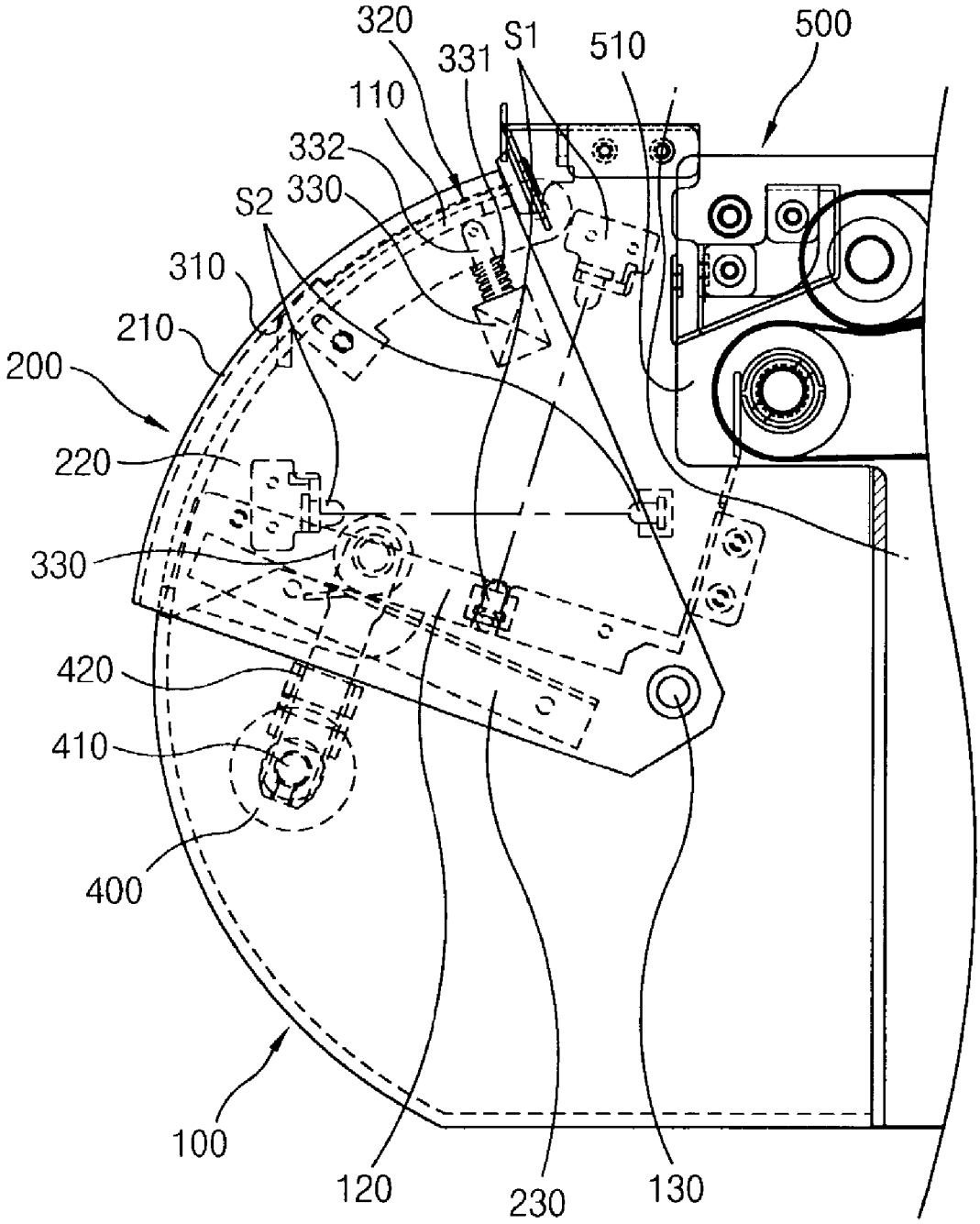
FIG. 9 is a diagram showing the media dispenser module of FIG. 4.

Thereby, the protruded portions 322 of the catching members 320 are controllably released from the catching portion 310 of the door 200, and the door 200 can move. At that time, the guide pins 121 tend to be located on upper part of the guide recess 323 as shown in FIG. 8.

In addition, when the door 200 closes the opening portion 110 of the casing 200 from an opened position of the opening portion 110 of the casing 100, operations of the catching member driving portion 330 is preferably stopped. The catching members 320 are pushed by the elastic force of the elastic member 331, and then, the protruded portions 322 are matched with the catching portion 310 of the door to prevent the door 200 from being opened. However, the present invention is not intended to be so limited as the catching members 320 can be engaged to the catching portion 310 under force provided by the catching member driving portion 300.

According to preferred embodiments of the present invention, the door 200 for opening/closing the opening portion 110 of the casing 100 is locked because both sides of the door 200 are restrained by the catching members 320. Further, the catching members 320 extend in the same direction as the door 200. Accordingly, the locked status of the door 200 becomes firm and the door 200 can be locked in equilibrium. Also, a second catching member 320 can be moved by being geared through the rotary shaft 350 to the operation of a first catching member 320. Further, the operational mechanism is low cost and does not require additional space.

As described above, in preferred embodiments of an ATM according to the present invention the locked status of the door that opens/closes the outlet through which the user withdraws the media (e.g., cash/check) is secure. The opening portion is securely engaged in the locked portion. Further, twisting of the door to one side can be reduced or prevented. Therefore, the robbery of cash by an inappropriate user through the opening portion of the casing can be reduced or prevented. Finally, reliability of the device can be increased.

The foregoing embodiments and advantages are merely exemplary and are not to be construed as limiting the present invention. The present teaching can be readily applied to other types of apparatuses. The description of the present invention is intended to be illustrative, and not to limit the scope of the claims. Many alternatives, modifications, and variations will be apparent to those skilled in the art. In the claims, means-plus-function clauses are intended to cover the structures described herein as performing the recited function and not only structural equivalents but also equivalent structures.

What is claimed is:

1. An apparatus, comprising a casing configured to receive dispensed media;

a door configured to cover an opening portion of the casing, and to move between a first position where the casing is open and the dispensed media is accessible to the outside and a second position where the casing is closed, wherein the door comprises a pair of catching portions respectively formed on both sides of the door corresponding to both sides of the opening portion of the casing; and a locking mechanism configured to selectively engage each of the pair of catching portions when the door is in the second position so as to secure the door in the second position when engaged, wherein a first end of the locking mechanism is operatively coupled to a portion of the casing, and a second end of the locking mechanism is configured to operate about the first end and to selectively engage with each of the pair of catching portions, wherein the locking mechanism comprises:

a rotary shaft installed on the casing in a transverse direction of the media holder;

a pair of rotatable catching members coupled to the rotary shaft and configured to be respectively engaged by the pair of catching portions when the door is closed; and a catching member driving portion installed on a side portion of the media holder and configured to rotate the pair of catching members so as to disengage the pair of catching members when the door is opened, wherein the catching member driving portion is installed on only one side surface of the media holder, and when one of the pair of catching members is rotated by the catching member driving portion, the other catching member is rotated in response to a rotation of the rotary shaft, and wherein the catching member driving portion comprises a linear driving device, wherein an end portion of the catching member driving portion is coupled to one of the pair of catching members at a position apart from where the catching member is coupled to the rotary shaft, and wherein the catching member driving portion is configured to drive a shaft thereof in a direction substantially perpendicular to a moving direction of the door, and wherein the pair of catching members are aligned with the pair of catching portions.

2. The apparatus of claim 1, wherein the casing comprises a media holder configured to support dispensed media, wherein the media holder comprises a 'U' shaped transverse cross section, and wherein a transverse cross section of the door corresponding to the opening portion makes an arc having a substantially constant radius of curvature when a moving direction of the door is a direction tangential to the radius of the arc.

3. The apparatus of claim 2, wherein the door is rotatably coupled to a hinge shaft that is installed on the media holder.

4. The apparatus of claim 3, further comprising door driving means for rotating the door, wherein said door driving means is disposed on one side of the casing.

5. The apparatus of claim 1, wherein the linear driving device comprises a solenoid.

6. The apparatus of claim 1, further comprising a forcing member coupled to the catching member driving portion and the pair of catching members, wherein the forcing member is configured to force the pair of catching members toward an engagement position with the pair of catching portions.

7. The apparatus of claim 1, wherein the locking mechanism comprises:

a pair of rotatable members configured to engage the pair of catching portions when the door is closed; and a member driving portion installed on a side portion of the casing and configured to operate the pair of rotatable members so as to disengage the pair of rotable members from the pair of catching portions, wherein the catching member driving portion is configured to move in a direction substantially perpendicular to a moving direction of the door.

8. The apparatus of claim 1, wherein the casing comprises a cover portion having an opening corresponding to a size of a moving area of the door, and wherein the locking mechanism is inaccessible from an outside of the casing when the door and the cover portion are in a closed position.

9. The apparatus of claim 1, wherein the apparatus is a media dispenser module.

10. The apparatus of claim 1, wherein the pair of catching portions are respectively formed on right and left sides of the door corresponding to right and left sides of the opening portion of the casing.

11. The apparatus of claim 1, wherein the pair of catching portions are respectively formed at edge portions of both sides of an inner surface of the door.

12. The apparatus of claim 1, wherein a first end portion of each of the pair of rotatable catching members is operatively coupled to the rotary shaft, and a second end portion of each of the pair of rotatable catching members comprises a protruded portion configured to engage with a respective catching portion of the pair of catching portions.

13. The apparatus of claim 12, wherein a first end portion of each of the pair of rotatable catching members is rotatably coupled to the rotary shaft.

14. The apparatus of claim 12, wherein each of the protruded portions comprises a stepped portion configured to engage with a corresponding stepped portion formed in a respective catching portion.

15. The apparatus of claim 12, wherein the protruded portion comprises a guide recess formed as a curve centered about the rotary shaft and configured to interact with a corresponding guide pin positioned on a portion of the casing so as to guide a movement of each of the pair of catching members.

* * * * *